US009423735B2

(12) United States Patent
Maruyama et al.

(10) Patent No.: US 9,423,735 B2
(45) Date of Patent: Aug. 23, 2016

(54) FIXING DEVICE

(71) Applicant: Brother Kogyo Kabushiki Kaisha, Nagoya-shi, Aichi-ken (JP)

(72) Inventors: Yasuhiro Maruyama, Kasugai (JP); Tomoaki Hazeyama, Yokkaichi (JP); Naoyuki Iwata, Kagamihara (JP); Akihiro Kobayashi, Yokkaichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/670,752

(22) Filed: Mar. 27, 2015

(65) Prior Publication Data

US 2015/0277315 A1 Oct. 1, 2015

(30) Foreign Application Priority Data

Mar. 31, 2014 (JP) ..... 2014-074790

(51) Int. Cl.
*G03G 15/20* (2006.01)

(52) U.S. Cl.
CPC ..... *G03G 15/2053* (2013.01); *G03G 15/2064* (2013.01); *G03G 2215/2035* (2013.01)

(58) Field of Classification Search
CPC ..... G03G 15/2017; G03G 15/2042; G03G 15/2046; G03G 15/2053; G03G 2215/2035
See application file for complete search history.

(56) References Cited

U.S. PATENT DOCUMENTS

| | | | | |
|---|---|---|---|---|
| 8,737,893 | B2 | 5/2014 | Fujiwara et al. | |
| 2011/0158718 | A1 | 6/2011 | Fujiwara et al. | |
| 2011/0164905 | A1* | 7/2011 | Kondo | G03G 15/2053 399/328 |
| 2011/0170920 | A1 | 7/2011 | Fujiwara et al. | |

FOREIGN PATENT DOCUMENTS

| | | | |
|---|---|---|---|
| JP | 2011-095534 | A | 5/2011 |
| JP | 2011-137933 | A | 7/2011 |

* cited by examiner

*Primary Examiner* — Erika J Villaluna
(74) *Attorney, Agent, or Firm* — Banner & Witcoff, Ltd.

(57) ABSTRACT

A fixing device may include an endless belt and a nip member in contact with an inner peripheral surface of the endless belt. The fixing device may further include a backup member that nips the endless belt together with the nip member. The fixing device may include a contact member disposed opposite the backup member with the nip member therebetween. The contact member may be in contact with the nip member. The contact member may include a first portion that extends across a width of a maximum image forming area and a second portion positioned outside the width of the maximum image forming area and inside a width of the nip in an axial direction of the endless belt. A heat transfer coefficient per unit dimension between the nip member and the second portion may be smaller than that between the nip member and the first portion.

20 Claims, 13 Drawing Sheets

FIXING DEVICE

CROSS-REFERENCE TO RELATED APPLICATION

This application claims priority from Japanese Patent Application No. 2014-074790, filed on Mar. 31, 2014, which is incorporated herein by reference in its entirety.

TECHNICAL FIELD

Aspects of invention relate to a fixing device that thermally fixes a developer image on a recording sheet.

BACKGROUND

A fixing device is known that includes an endless belt, a heating element and a nip member that are disposed in the endless belt, a backup member that nips the endless belt together with the nip member so as to form a nip together with the endless belt, and a reflection member that reflects radiant heat from the heating element towards the nip member (see JP2011095534A). Specifically, in the above technique, the reflection member is configured in a U-shape in cross-sectional view and is in contact with both edge portions of the nip member in the sheet transport direction from the opposite side with respect to the backup member. Furthermore, portions of the reflection member that are in contact with the nip member are formed so as to extend across substantially one end to substantially the other end of the nip member in the longitudinal direction (in detail, an area corresponding to one end to the other end of the nip).

SUMMARY

However, in the known technique, since the reflection member is in contact with the nip member across substantially one end to substantially the other end of the nip member in the longitudinal direction, when heating the endless belt with the heating element through the nip member at the beginning of printing, heat escapes from the end portions of the nip member to the reflection member; accordingly, temperatures of the edge portions of the endless belt may disadvantageously become insufficient.

Aspects of the invention may provide a fixing device that is capable of hindering the temperatures of edge portions of an endless belt from becoming insufficient at the beginning of printing.

The fixing device may include an endless belt and a nip member being in contact with an inner peripheral surface of the endless belt. The fixing device may further include a backup member that nips the endless belt together with the nip member forms a nip together with the endless belt. The fixing device may still further include a contact member disposed opposite the backup member with the nip member therebetween. The contact member may be in contact with the nip member. The contact member may include a first portion that extends across a width of a maximum image forming area in an axial direction of the endless belt and a second portion positioned outside the width of the maximum image forming area in the axial direction of the endless belt and positioned inside a width of the nip in the axial direction of the endless belt. A heat transfer coefficient per unit dimension between the nip member and the second portion in the axial direction may be smaller than a heat transfer coefficient per unit dimension between the nip member and the first portion in the axial direction.

DETAILED DESCRIPTION

Figure 1:
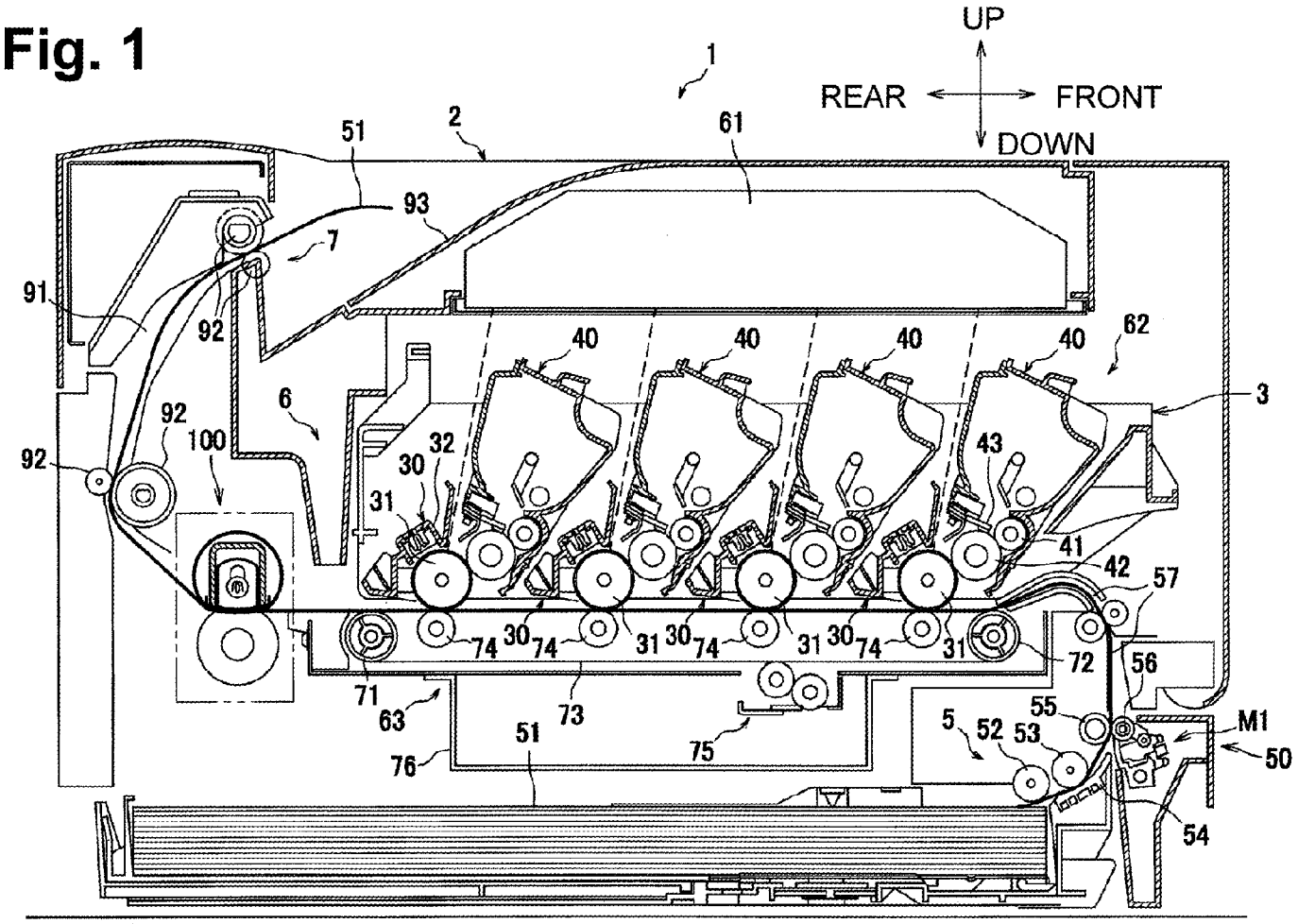
FIG. 1 is a cross-sectional view illustrating a color laser printer including a fixing device according to an embodiment of the present disclosure.

An embodiment of the present disclosure will be described in detail next while referring to the drawings as required. Note that in the description below, if not otherwise specified, directions will be set forth such that the up-down direction illustrated in FIG. 1 is the up-down direction, the right side in FIG. 1 is the front direction, the left side is the rear direction, the near side with respect to the sheet surface is the left direction, and the far side with respect to the sheet surface is the right direction. The left and right herein are defined on the basis of the directions seen from a person standing on a front side of a color laser printer 1.

As illustrated in FIG. 1, the color laser printer 1 includes, inside a device body 2, a sheet feeding portion 5 that feeds a sheet 51 (a recording sheet), an image forming portion 6 that forms an image on the sheet 51 that has been fed thereto, and a sheet discharging portion 7 that discharges the sheet 51 on which an image has been formed.

The sheet feeding portion 5 in the lower portion inside the device body 2 includes a sheet feed tray 50 that is attached and detached through the front side of the device body 2 with a slide operation and a sheet feed mechanism M1 that lifts up the front side of the sheet 51 from the sheet feed tray 50, turns the sheet 51 over to the rear side, and transports the sheet 51.

The sheet feed mechanism M1 includes a pickup roller 52, a separation roller 53, and a separation pad 54 that are provided near the front end portion of the sheet feed tray 50 such that the stack of sheets 51 in the sheet feed tray 50 are separated into separate sheets and are sent upwards. The sheet 51 that has been transported upwards passes between a paper powder removing roller 55 and a pinch roller 56, passes through a transport path 57 and is turned towards the rear, and is fed onto a transport belt 73 described later. While the sheet 51 is passing between the paper powder removing roller 55 and the pinch roller 56, paper powder that has adhered to the sheet 51 is removed from the sheet 51 with the paper powder removing roller 55.

The image forming portion 6 includes a scanner portion 61, a processing portion 62, a transfer portion 63, and a fixing device 100.

The scanner portion 61 is provided on the upper portion of the device body 2 and includes, although not shown, a laser emission portion, a polygon mirror, a plurality of lens, and a reflecting mirror. In the scanner portion 61, laser that corresponds to colors, such as cyan, magenta, yellow, and black and that is emitted from the laser emission portion is scanned in the left and right directions at high speed with the polygon mirror, is passed through the plurality of lens and is reflected on the reflecting mirror, and is irradiated on photosensitive drums 31.

The processing portion 62 includes a photoreceptor unit 3 that is disposed below the scanner portion 61 and above the sheet feeding portion 5 and that is movable in the front-rear direction with respect to the device body 2. The photoreceptor unit 3 includes drum sub-units 30, and developing cartridges 40 that are mounted on the drum sub-units 30.

The drum sub-units 30 include known photosensitive drums 31 and known scorotron type electrifiers 32. The developing cartridges 40 accommodate therein toners serving as examples of the developer and include known feed rollers 41, known development rollers 42, and known layer thickness regulating blades 43.

The above processing portion 62 functions in the following manner. Toners inside the developing cartridges 40 are fed to the development rollers 42 with the feed rollers 41. At this point, the toners are positively electrified by friction between the feed rollers 41 and the development rollers 42. The toners that have been fed to the development rollers 42 are scraped by the layer thickness regulating blades 43 upon rotation of the development rollers 42 and are carried on the surface of the development rollers 42 as thin layers each with a uniform thickness.

Meanwhile, in the drum sub-units 30, the scorotron type electrifiers 32 positively charge the photosensitive drums 31 in a uniform manner by corona discharge. Laser is irradiated on the charged photosensitive drums 31 from the scanner portion 61 and electrostatic latent images corresponding to the image to be formed on the sheet 51 are formed on the photosensitive drums 31.

Furthermore, upon rotation of the photosensitive drums 31, the toners carried by the development rollers 42 are supplied to the electrostatic latent images of the photosensitive drums 31, in other words, in the surfaces of the photosensitive drums 31 positively charged in a uniform manner, the toners are supplied to portions exposed to laser and to where the potentials have been reduced. With the above, the electrostatic latent images of the photosensitive drums 31 are each turned into visible images and toner images each corresponding to a color of the corresponding toner are created by reversal development and are carried on the surfaces of the photosensitive drums 31.

The transfer portion 63 includes a driving roller 71, a driven roller 72, the transport belt 73, transfer rollers 74, and a cleaning portion 75.

The driving roller 71 and the driven roller 72 are disposed so as to be spaced apart from each other at the front and rear in a parallel manner, and the transport belt 73 formed of an endless belt is wound around the driving roller 71 and the driven roller 72. The outer surface of the transport belt 73 is in contact with each of the photosensitive drums 31. Furthermore, the transfer rollers 74 that nip the transport belt 73 together with the photosensitive drums 31 are disposed inside the transport belt 73. Transfer biases are applied to the transfer rollers 74 from a high voltage substrate (not shown). When forming an image, the sheet 51 that has been transported with the transport belt 73 is nipped between the photosensitive drums 31 and the transfer rollers 74 and the toner images on the photosensitive drums 31 are transferred onto the sheet 51.

The cleaning portion 75 is disposed below the transport belt 73. The cleaning portion 75 removes the toner adhered to the transport belt 73 and drops the removed toner into a toner reservoir 76 disposed therebelow.

The fixing device 100 is provided on the rear side with respect to the transfer portion 63 and thermally fixes the toner image, which has been transferred onto the sheet 51, on the sheet 51. Note that a detailed description of the fixing device 100 will be given later.

In the sheet discharging portion 7, a sheet-discharge-side transport path 91 of the sheet 51 is formed so as to extend upwards from the exit of the fixing device 100 and turn over towards the front side. A plurality of transport rollers 92 that transport the sheet 51 are disposed through the sheet-discharge-side transport path 91. A sheet discharge tray 93, which accumulates the sheet 51 to which printing has been performed, is formed on the upper surface of the device body 2. The sheets 51 that have been discharged from the sheet-discharge-side transport path 91 with the transport rollers 92 are accumulated on the sheet discharge tray 93.

Detailed Configuration of the Fixing Device

Figure 2:
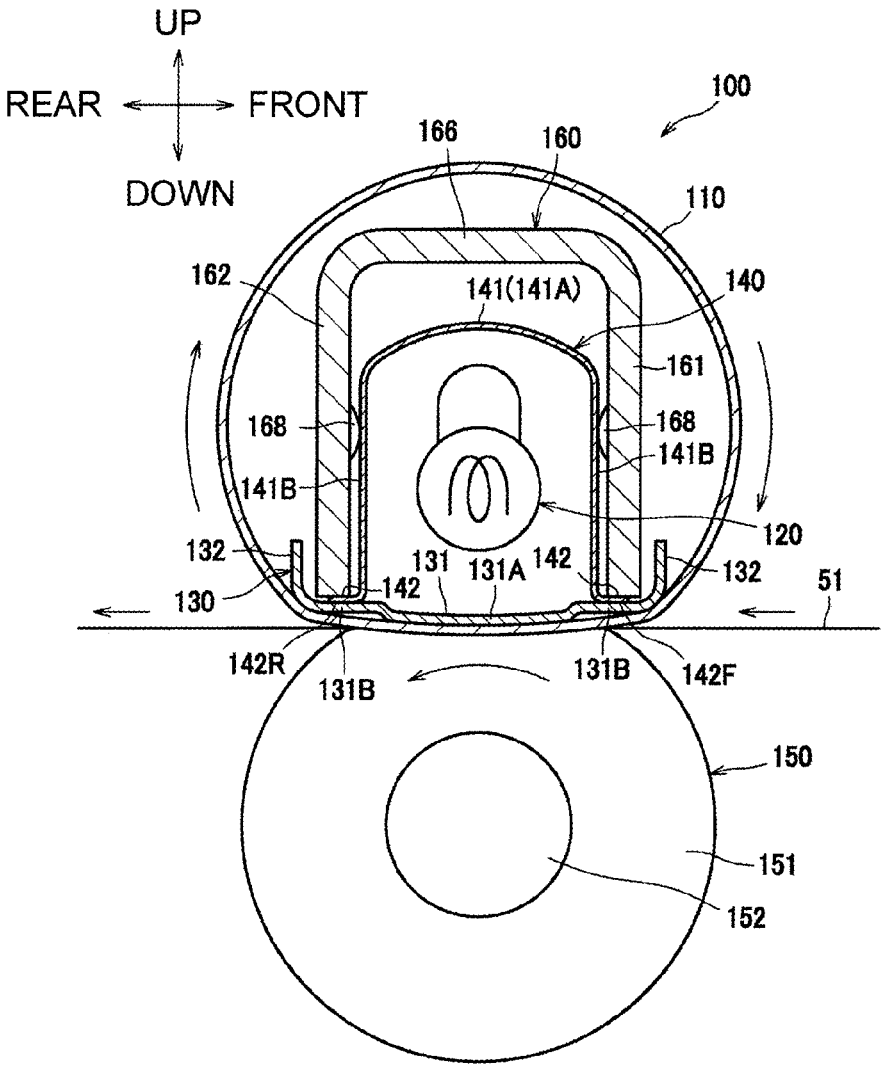
FIG. 2 is a cross-sectional view illustrating the fixing device.

As illustrated in FIG. 2, the fixing device 100 mainly includes a fixing belt 110 serving as an example of an endless belt, a halogen lamp 120 serving as an example of a heating element, a nip plate 130 serving as an example of a nip member, a reflecting plate 140 serving as an example of a contact member, a pressure roller 150 serving as an example of a backup member, and a stay 160.

Note that in the following description, the transport direction of the sheet 51 (substantially the front-rear direction) is merely referred to as a "transport direction" and the axial direction of the fixing belt 110 (substantially the left-right direction) is merely referred to as an "axial direction". Furthermore, the pressing direction of the pressure roller 150 (substantially the up-down direction) is merely referred to as a "pressing direction".

The fixing belt 110 is a heat resistant and flexible endless (tubular) belt. The fixing belt 110 is configured so as to be rotatable and the two edge portions in the axial direction are guided by a guide member (not shown).

Note that the fixing belt 110 may be configured as a metal belt including a metal base material and resin coated on the outer periphery of the base material, may be configured so as to have a rubber layer on a surface of a metal, or may be configured so as to further have a protective layer formed of nonmetal, such as a fluorine coating, on the surface of the rubber layer.

The halogen lamp 120 is a heating element that heats the toner on the sheet 51 by heating the nip plate 130 and the fixing belt 110 and is disposed inside the fixing belt 110 while being spaced apart at a predetermined distance with the inner surfaces of the fixing belt 110 and the nip plate 130.

The nip plate 130 receives pressing force of the pressure roller 150 and is a plate-shaped member that transmits radiant heat from the halogen lamp 120 to the toner on the sheet 51 through the fixing belt 110. The nip plate 130 is disposed so as to be in contact with the inner peripheral surface of the tubular fixing belt 110.

The nip plate 130 includes a metal plate. The metal plate may be an aluminum plate or may be an SUS plate.

The nip plate 130 is formed by bending, for example, an aluminum plate that has a thermal conductivity that is greater than that of the steel stay 160 described later into a substantially U-shape in cross-sectional view. In more detail, the nip plate 130 in cross-sectional view mainly includes a base portion 131 that extends in the transport direction and sidewall portions 132 that extend upwards from each of the edge portions of the base portion 131 in the front-rear direction.

The base portion 131 is bent and formed such that a middle portion 131A in the transport direction forms a convexity extending towards the pressure roller 150 side (downwards) with respect to the two edge portions 131B. Note that a black coating or a heat absorption member may be provided on the inner surface (the upper surface) of the base portion 131. With the above, radiant heat from the halogen lamp 120 can be efficiently absorbed.

Figure 3:
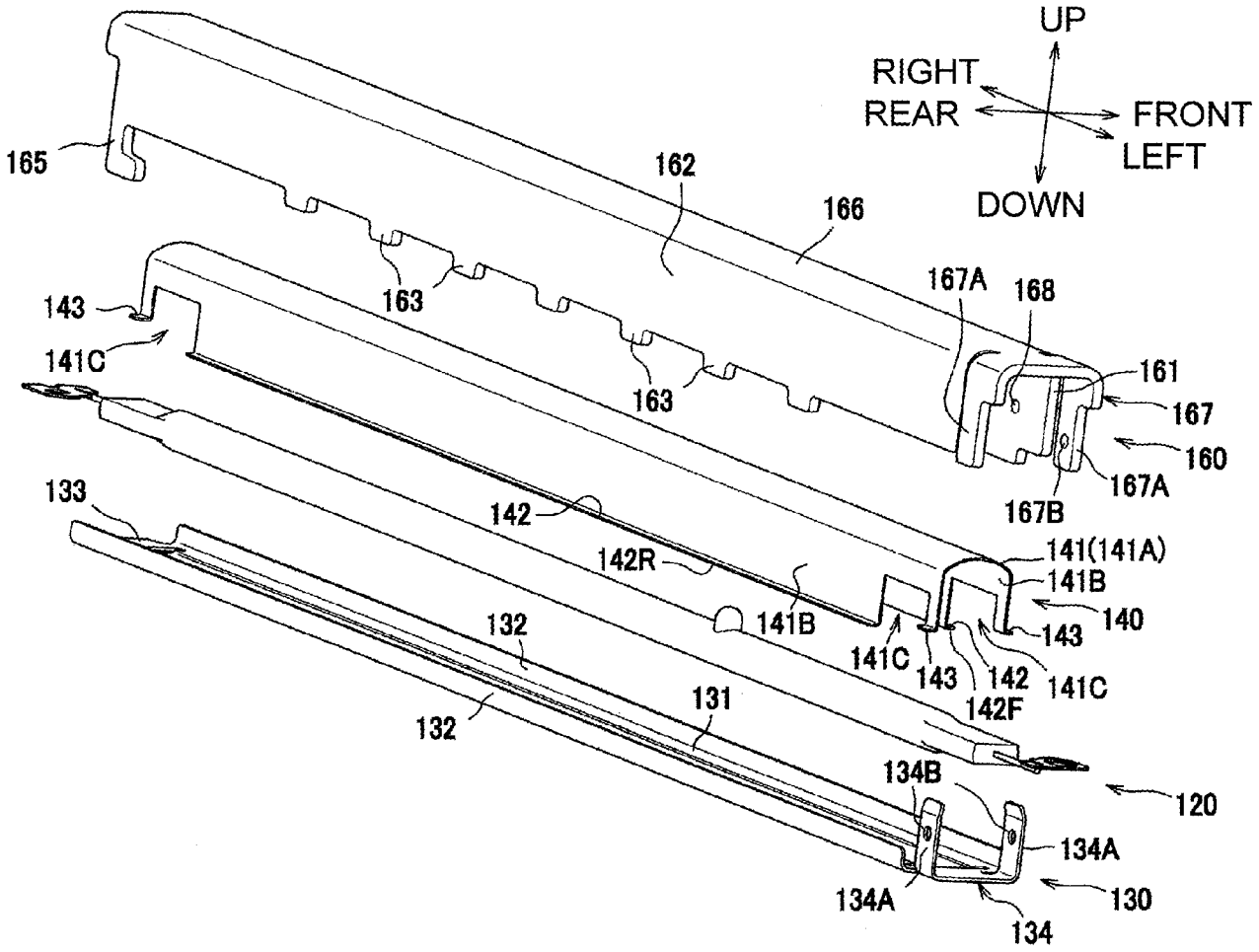
FIG. 3 is an exploded perspective view in which a nip plate and other components have been disassembled.

As illustrated in FIG. 3, the nip plate 130 further includes an insertion portion 133 that extends in a tabular manner from the right end portion of the base portion 131 and an engagement portion 134 that is formed at the left end portion of the base portion 131. The engagement portion 134 is formed in a U-shape in side view and engagement holes 134B are provided in sidewall portions 134A that have been formed by being bent upwards.

As illustrated in FIG. 2, the reflecting plate 140 is a member that reflects the radiant heat (mainly the radiant heat radiated in the front-rear direction and the upper direction) from the halogen lamp 120 towards the nip plate 130 (the inner surface of the base portion 131) and is disposed inside the fixing belt 110 so as to surround the halogen lamp 120 while being spaced apart at a predetermined distance from the halogen lamp 120.

With such a reflecting plate 140, radiant heat from the halogen lamp 120 is collected to the nip plate 130; accordingly, the radiant heat from the halogen lamp 120 can be used efficiently and the nip plate 130 and the fixing belt 110 can be heated promptly.

Furthermore, the reflecting plate 140 is disposed on the opposite side with respect to the pressure roller 150 with the nip plate 130 therebetween and receives force from the pressure roller 150 by being in contact with the nip plate 130. Note that in the present embodiment, a pressing mechanism (not shown) presses the stay 160 downwards. With the above, the pressing force from the pressing mechanism is transmitted to the pressure roller 150 through the stay 160, the reflecting plate 140, the nip plate 130, and the fixing belt 110. Furthermore, reaction force against the pressing force is generated towards the upper direction from the pressure roller 150. The reaction force is received by the reflecting plate 140 through the fixing belt 110 and the nip plate 130.

Note that opposite to the above, the pressure roller 150 may be biased towards the stay 160.

The reflecting plate 140 includes a metal plate. For example, the metal plate may be an aluminum plate or may be an SUS plate. The thickness of the reflecting plate is 0.3 mm, for example.

The reflecting plate 140 is formed by bending, for example, an aluminum plate that has a large reflectivity of infrared rays and far-infrared rays into a substantially U-shape in cross-sectional view. In more detail, the reflecting plate 140 mainly includes a reflecting portion 141 having a curved shape (a substantially U-shape in cross-sectional view) and flange portions 142 that extend in the transport direction from the two edge portions of the reflecting portion 141. Note that in order to increase the heat reflectivity, the reflecting plate 140 may be formed using an aluminum plate on which mirror finishing has been performed.

Figure 5:
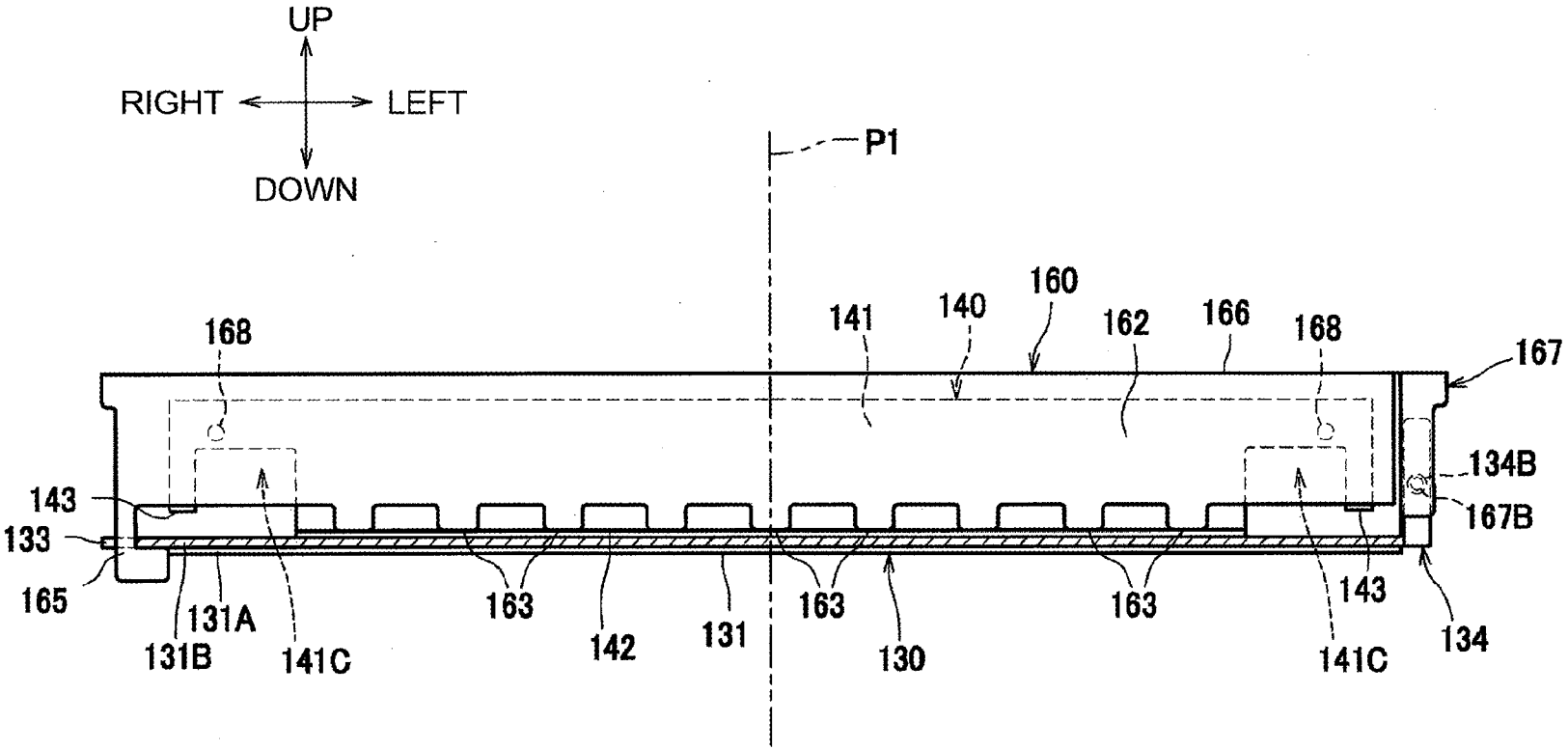
FIG. 5 is a diagram illustrating a relationship between the nip plate, the reflecting plate, and a stay.

As illustrated in FIG. 3, a total of four flange-shaped lock portions 143 (only three thereof are illustrated) are formed in the two end portions of the reflecting plate 140 in the axial direction. The lock portions 143 are positioned above the flange portions 142 and, as illustrated in FIG. 5, are disposed so as to be engaged with lower edges of a front wall 161 and a rear wall 162 of the stay 160 described later when the nip plate 130, the reflecting plate 140, and the stay 160 are assembled.

As illustrated in FIGS. 2 and 3, the reflecting portion 141 includes an arcuate upper wall portion 141A and a pair of sidewall portions 141B that extend downwards from the front and rear edges of the upper wall portion 141A. The lock portions 143 described above are provided at the two end portions of each of the sidewall portions 141B in the axial direction, and U-shaped cutouts 141C (a total of four) each open downwards is formed on the inner side of each of the lock portions 143 in the axial direction. The flange portions 142 are provided on the inner sides of the cutouts 141C in the axial direction. In detail, the reflecting plate 140 includes the following at each of the front and rear portions thereof: a pair of lock portions 143 that are spaced apart from each other in the axial direction, a pair of cutouts 141C that are disposed on the inner side of the lock portions 143 in the axial direction, and a flange portion 142 that is disposed between the pair of cutouts 141C.

Among the front and rear flange portions 142, the underside of the flange portion 142 on the front side (on the upstream side in the transport direction) is an upstream supporting surface 142F that supports the edge portion 131B on the upstream side of the nip plate 130. Furthermore, the underside of the flange portion 142 on the rear side (on the downstream side in the transport direction) is a downstream supporting surface 142R that supports the edge portion 131B on the downstream side of the nip plate 130.

The downstream supporting surface 142R is set apart from the upstream supporting surface 142F and is disposed on the downstream side in the transport direction (the moving direction of the fixing belt 110 relative to the nip) with respect to the upstream supporting surface 142F. Furthermore, the cutouts 141C described above are formed in both of the upstream supporting surface 142F and the downstream supporting surface 142R.

Figure 4:
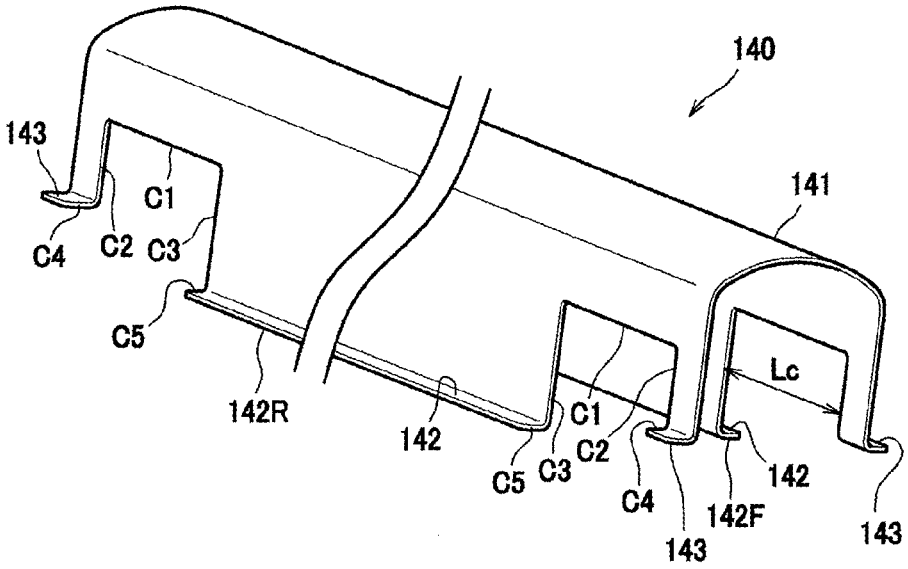
FIG. 4 is a perspective view in which the two end portions of the reflecting plate are illustrated in enlarged manner.

As illustrated in FIG. 4, each of the cutouts 141C is constituted by a first surface C1 that is disposed so as to be spaced apart from the nip plate 130 in the up-down direction, a second surface C2 that extends downwards from the end of the first surface C1 on the outer side in the axial direction, a third surface C3 that extends downwards from the end of the first surface C1 on the inner side in the axial direction, a fourth surface C4 that extends outwardly in the transport direction from the lower end of the second surface C2, and a fifth surface C5 that extends outwardly in the transport direction from the lower end of the third surface C3. Note that a length Lc of each of the cutouts 141C in the axial direction may be 2.0 to 5.0 mm, 5.0 to 10.0 mm, 2.0 to 15.0 mm, or 3.0 to 25.0 mm.

As illustrated in FIG. 2, the pressure roller 150 nips the fixing belt 110 together with the nip plate 130, is a member that forms a nip portion together with the fixing belt 110, and is disposed below the nip plate 130. In more detail, the pressure roller 150 forms a nip together with the fixing belt 110 by pressing the nip plate 130 through the fixing belt 110.

The pressure roller 150 includes a cylindrical roller body 151 and a shaft 152 that is inserted in the roller body 151 and that is rotatable together with the roller body 151. The roller body 151 can be elastically deformed.

The pressure roller 150 is configured so as to be rotationally driven by transmission of a driving power from a motor (not shown) provided inside the device body 2. By being rotationally driven, the pressure roller 150, with the frictional force between the fixing belt 110 (or the sheet 51), makes the fixing belt 110 rotate in a driven manner.

The sheet 51 on which the toner images have been transferred is transported between the pressure roller 150 and the heated fixing belt 110 (the nip); accordingly, the toner images (toners) are thermally fixed thereon.

The stay 160 is a metal member that secures the rigidity of the nip plate 130 by supporting the two edge portions 131B of the nip plate 130 (the base portion 131) in the transport direction. The stay 160 has a shape (a substantially U-shape in cross-sectional view) that extends along the shape of the outer surface of the reflecting plate 140 (the reflecting portion 141) and is disposed so as to cover the reflecting plate 140. Such a stay 160 is formed by bending, for example, a steel plate that has a relatively high rigidity into a substantially U-shape in cross-sectional view.

As illustrated in FIGS. 3 and 5, a plurality of support portions 163 are provided so as to protrude downwards in the lower edges of the front wall 161 and the rear wall 162 of the stay 160. Each of the support portions 163 supports the nip plate 130 through the flange portions 142 of the reflecting plate 140.

Furthermore, a lock portion 165 having a substantially L-shape that extends downwards and, further, leftwards is provided in each of the right end portions of the front wall 161 and the rear wall 162 of the stay 160. The right end portion of the nip plate 130 is supported by the lock portions 165. Furthermore, a holding portion 167 that extends towards the left from the upper wall 166 and that is bent in a substantially U-shape in side view is provided at the left end of the stay 160. Engagement bosses 167B (only the engagement boss 167B on one side is illustrated) that engage with the engagement holes 134B of the nip plate 130 described above and that extend towards the inner side are provided on inner surfaces of sidewall portions 167A of the holding portion 167.

As illustrated in FIGS. 2 and 3, abutment bosses 168, four in total, that protrude towards the inner side are provided at the two end portions of the inner surfaces of the front wall 161 and the rear wall 162 of the stay 160 in the axial direction. The abutment bosses 168 abuts against the reflecting plate 140 (the reflecting portion 141) in the transport direction. With the above, even when the reflecting plate 140 is about to be moved in the front-rear direction with the vibration or the like generated when the fixing device 100 is driven, the displacement of the reflecting plate 140 in the transport direction is restricted with the abutting abutment bosses 168. As a result, the reflecting plate 140 can be prevented from being out of position in the transport direction.

Details of the Reflecting Plate

A structure of the reflecting plate 140 will be described in detail next with reference to FIGS. 5 and 6. Note that in FIG. 5, a first plane P1 illustrated by a virtual line is a plane that passes through the transport center of the sheet 51 and that is orthogonal to the axial direction. Note that the transport center is a center of the sheet 51, which is transported by the fixing device 100, in the axial direction.

Note that in the present embodiment, a transporting method in which the transport center of the sheet 51 is aligned with the substantially center portion of the nip plate 130 in the left-right direction is adopted as the transporting method of the sheet 51; however, the transporting method is not limited to the above method and, for example, a transporting method in which an end of the sheet in the left-right direction is brought near to one end side of the nip plate in the left-right direction may be adopted.

Figure 6:
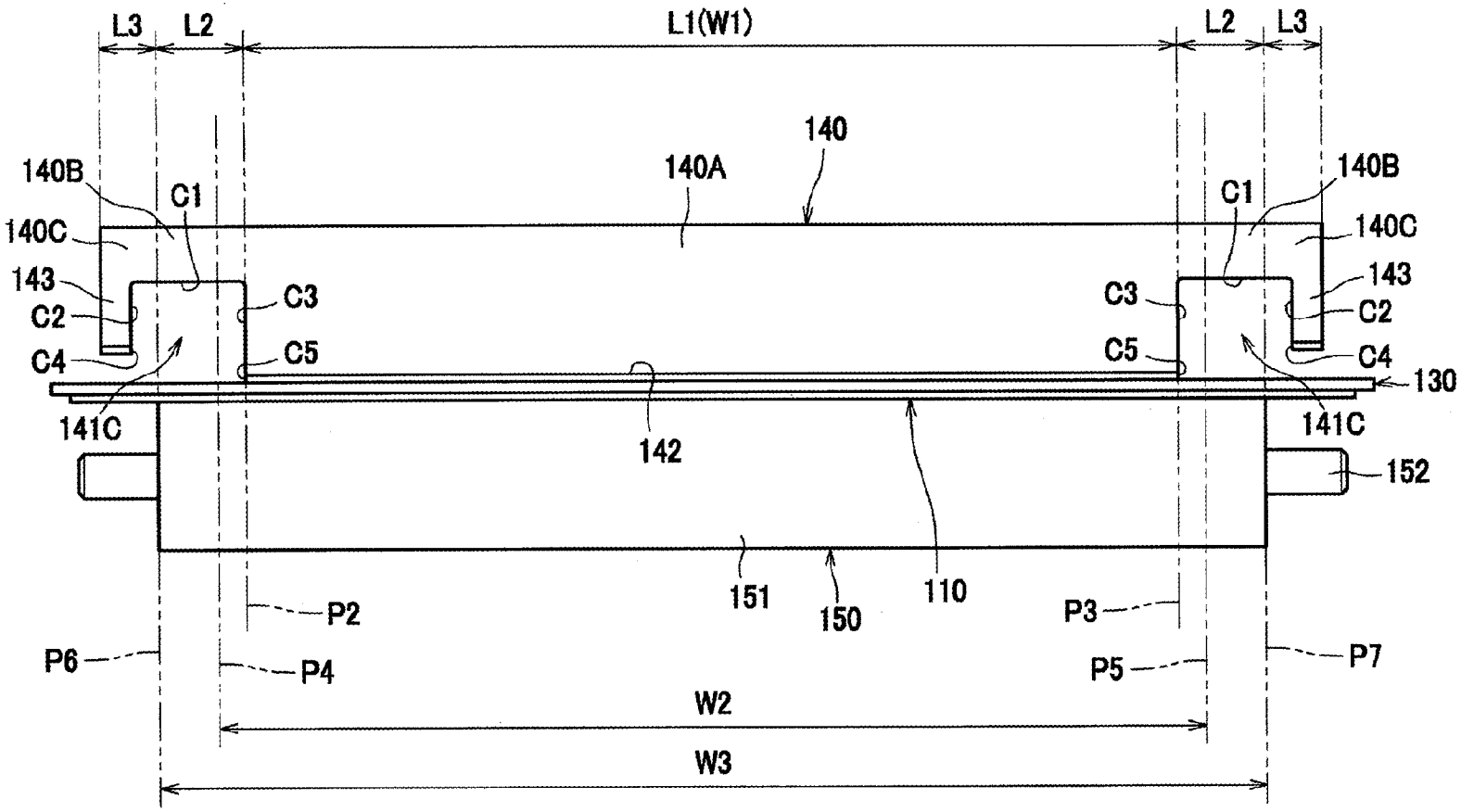
FIG. 6 is a diagram for describing a relationship between a first portion, a second portion, and a third portion.

Furthermore, referring to FIG. 6, a second plane P2 illustrated by a virtual line is a plane that passes through one edge of a maximum image forming area W1 and that is orthogonal to the axial direction, and a third plane P3 illustrated by a virtual line is a plane that passes through the other edge of the maximum image forming area W1 and that is orthogonal to the axial direction. Note that the maximum image forming area W1 refers to a width of the image having the largest dimension in the axial direction that can be formed by the color laser printer 1 (that can be fixed by the fixing device 100). Note that in a printer that is capable of performing printing without any margin, the value of the maximum image forming area W1 is the same as the value of a maximum sheet passing width W2 described later.

Furthermore, a fourth plane P4 illustrated by a virtual line is a plane that passes through one edge of the sheet 51 in the axial direction, the sheet 51 having the maximum sheet passing width W2, and that is orthogonal to the axial direction, and a fifth plane P5 illustrated by a virtual line is a plane that passes through the other edge of the sheet 51 in the axial direction, the sheet 51 having the maximum sheet passing width W2, and that is orthogonal to the axial direction. Note that the maximum sheet passing width W2 refers to a width of the sheet 51 having the largest dimension in the axial direction that can be printed by the color laser printer 1 (that can be fixed by the fixing device 100).

Furthermore, a sixth plane P6 illustrated by a virtual line is a plane that passes through one edge of the nip in the axial direction and that is orthogonal to the axial direction, and a seventh plane P7 illustrated by a virtual line is a plane that passes through the other edge of the nip in the axial direction and that is orthogonal to the axial direction. In other words, the length from the sixth plane P6 to the seventh plane P7 is a width W3 of the nip in the axial direction. Furthermore, in the present embodiment, the relationship between the maximum image forming area W1, the maximum sheet passing width W2, and the width W3 of the nip is $W1<W2<W3$.

As illustrated in FIG. 6, the reflecting plate 140 includes a first portion 140A that extends across the whole width of the maximum image forming area W1 in the axial direction, a pair of second portions 140B positioned outside the maximum image forming area W1 in the axial direction and inside the width W3 of the nip in the axial direction, and a pair of third portions 140C positioned outside of the width W3 of the nip in the axial direction.

The first portion 140A is a portion of the reflecting plate 140 between the second plane P2 and the third plane P3 and includes the middle portion of the reflecting portion 141, the flange portions 142, the third surfaces C3, and the fifth surfaces C5, which have been described above. A length L1 of the first portion 140A in the axial direction is the same as the width of the maximum image forming area W1.

The second portions 140B are portions of the reflecting plate 140 between the second plane P2 and the sixth plane P6 and between the third plane P3 and the seventh plane P7 and include portions of the reflecting portion 141 and portions of the first surfaces C1. A length L2 of each of the second portions 140B in the axial direction is shorter than the length L1 of the first portion 140A in the axial direction and is longer than a length L3 of each of the third portions 140C in the axial direction.

Furthermore, the second portions 140B do not come in contact with the nip plate 130. In other words, a second heat transfer coefficient Q2 per unit dimension between the nip plate 130 and each of the second portions 140B in the axial direction is smaller than a first heat transfer coefficient Q1 per unit dimension between the nip plate 130 and the first portion 140A in the axial direction. Here, each of the heat transfer coefficients Q1 and Q2 is to satisfy the following expression (1) when the length L2 of the second portions 140B is given as the unit dimension.

$$Q2<Q1\cdot L2/L1. \quad (1)$$

Note that the heat transfer coefficient in the present disclosure indicates the degree of heat transmission per unit length. The unit of the heat transfer coefficient is W/mK, where K is kelvin, m is meter, and W is watt. The larger the heat transfer coefficient, the easier it will be for the heat to be transmitted through objects per unit length in the axial direction.

In other words, the contact area per unit dimension between the second portions 140B and the nip plate 130 in the axial direction is smaller than the contact area per unit dimension between the first portion 140A and the nip plate 130 in the axial direction. By configuring the first portion 140A and the second portions 140B in the above manner, heat can be hindered from escaping from the nip plate 130 to the second portions 140B; accordingly, lack of temperature in the edge portions of the fixing belt 110 at the beginning of printing can be prevented.

The third portions 140C are portions of the reflecting plate 140 that are on the outside of the sixth plane P6 or the seventh plane P7 and include portions of the reflecting portion 141, the lock portions 143, the other portions of the first surfaces C1, the second surfaces C2, and the fourth surfaces C4, which have been described above.

Furthermore, the cutout 141C on one of the left and right sides is formed from the second plane P2 to the outside of the sixth plane P6 (the middle portion of the corresponding third portion 140C in the axial direction), and the cutout 141C on the other of the left and right sides is formed from the third plane P3 to the outside of the seventh plane P7 (the middle portion of the corresponding third portion 140C in the axial direction).

With the above configuration, the present embodiment can obtain the following effects. The cutout 141C is formed from the second plane P2 to the outside of the sixth plane P6 (or from the third plane P3 to the outside of the seventh plane P7), in other words, the entire second portions 140B do not come in contact with the nip plate 130; accordingly, heat can be favorably hindered from escaping from the nip plate 130 to the second portions 140B.

Note that the present disclosure is not limited to the above-described embodiment and may be employed in various forms such as those exemplified below. In the following description, members that have structures that are substantially similar to those of the embodiment described above are attached with the same reference numerals and description thereof is omitted.

Figure 7:
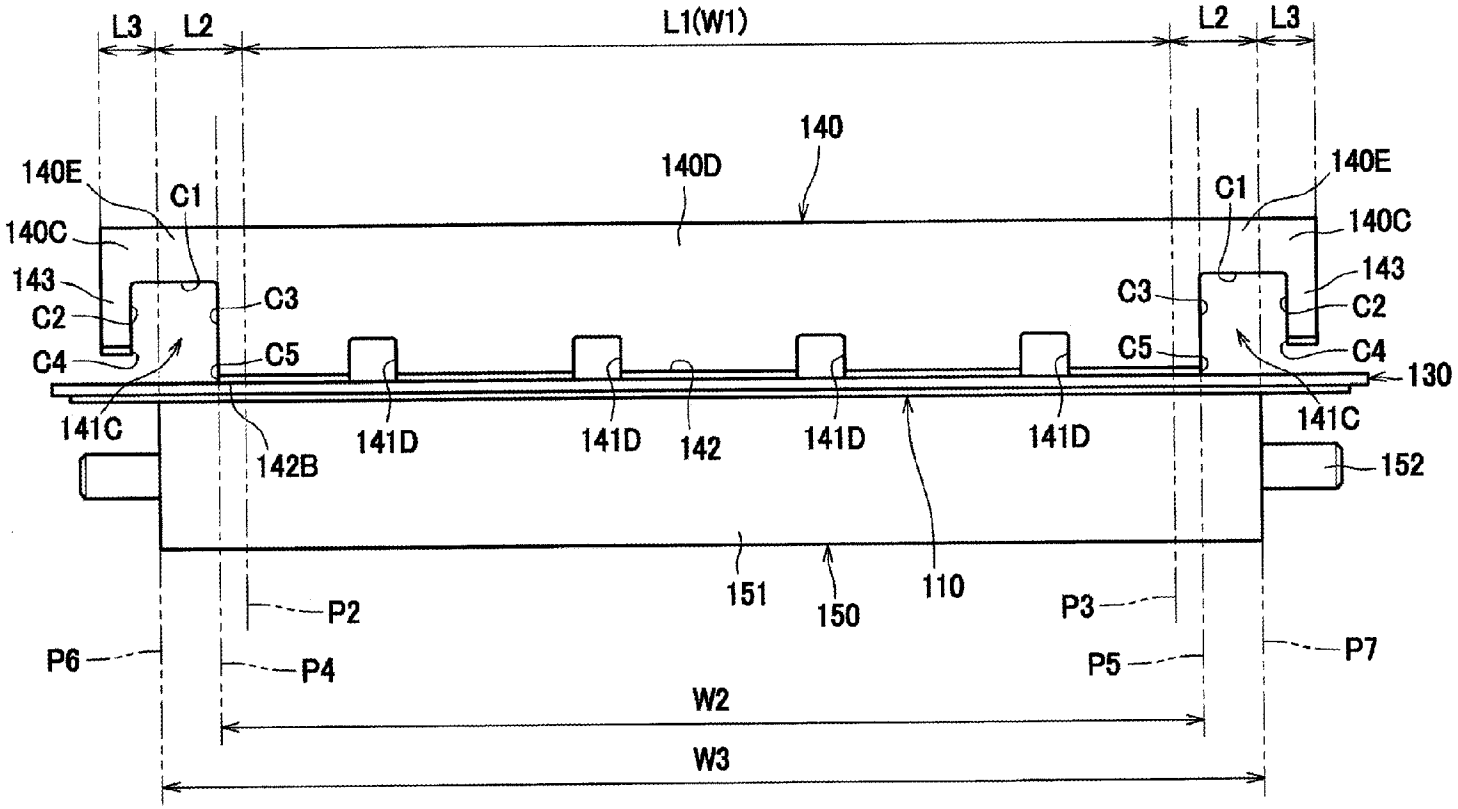
FIG. 7 is a diagram illustrating a first modification.

In the above-described embodiment, the entire second portions 140B do not come in contact with the nip plate 130; however, the present disclosure is not limited to the above configuration and, for example, as illustrated in FIG. 7, portions of second portions 140E (portions in the range of length L2) may be in contact with the nip plate 130. In other words, in the present form, the second portions 140E each include a portion of the reflecting portion 141, a portion of the flange portion 142, the corresponding third surface C3, the corresponding fifth surface C5, and a portion of the corresponding first surface C1, which have been described above.

Furthermore, the undersides of the flange portions 142 of the second portions 140E are contact surfaces 142B that are in contact with the nip plate 130. Furthermore, in the above case, the contact surfaces 142B are configured so as to include portions of the cutouts 141C described above. Furthermore, each of the cutouts 141C extends from an edge of the maximum sheet passing width W2 (the fourth plane P4 or the fifth plane P5) to a substantially middle portion of the corresponding third portion 140C.

A similar effect can also be obtained with the above form by having the relationship between the first heat transfer coefficient and the second heat transfer coefficient (between each of the contact areas) be similar to the relationship in the embodiment described above. Note that as illustrated in FIG. 7, a plurality of cutouts 141D may be provided in the flange portions 142 of first portions 140D as long as the relationship between each of the heat transfer coefficients is similar to that in the embodiment described above. Furthermore, in the present form, the range in which the reflecting plate 140 supports the nip plate 130 in the axial direction is the maximum sheet passing width W2 and is wider than that in the embodiment described above (the maximum image forming area W1); accordingly, the nip plate 130 can be supported by the reflecting plate 140 in a favorable manner.

Note that the size and the position of the cutouts are not limited to those in the embodiment described above and may be set optionally. For example, each of the cutouts may be formed so as to be within the areas of the corresponding second portion, maybe formed so as to extend from the corresponding second portion to a predetermined region of the corresponding first portion, or may be formed from a position outside of and away from the corresponding edge of the maximum sheet passing width to a predetermined region of the corresponding third portion.

Figure 8:
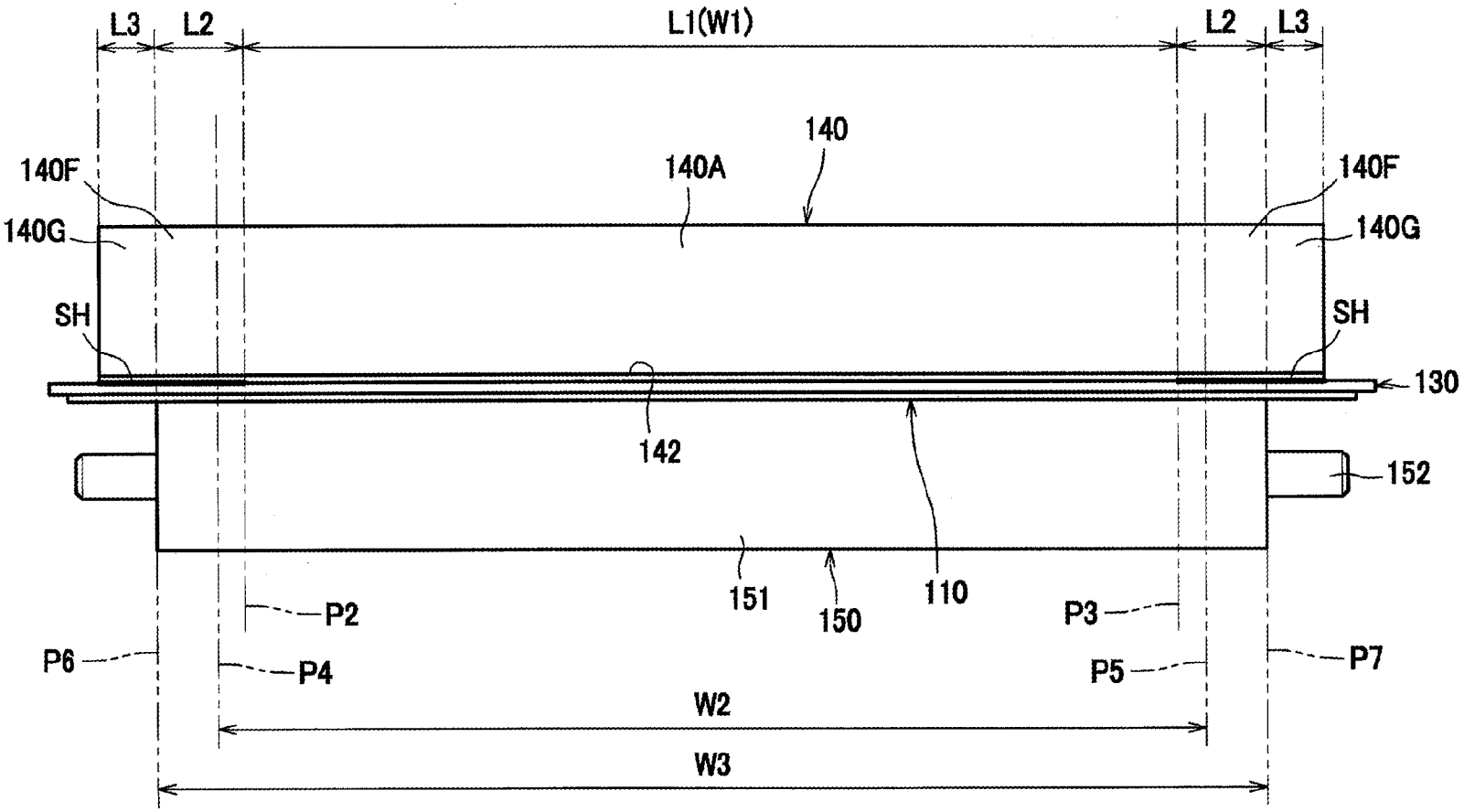
FIG. 8 is a diagram illustrating a second modification.

In the embodiment described above, heat is hindered from escaping from the nip plate 130 to the second portions 140B by forming the cutouts 141C in the second portions 140B; however, the present disclosure is not limited to the above configuration. For example, as illustrated in FIG. 8, heat escaping from the nip plate 130 to the second portions 140F can be hindered by providing heat insulation sheets SH that have a lower heat conductivity than that of the reflecting plate 140 between the second portions 140F and the nip plate 130.

In detail, in the present form, each heat insulation sheet SH extends from an inner end (the second plane P2 or the third plane P3) of the corresponding second portion 140F in the axial direction to an outer end (an outer end of the reflecting plate 140 in the axial direction) of a corresponding third portion 140G. Furthermore, while the first portion 140A is in contact with the nip plate 130, the heat insulation sheets SH are interposed between the second portions 140F and the third portions 140G, and the nip plate 130. In such a case as well, an effect similar to that of the embodiment described above can be obtained by having the relationship between the first heat transfer coefficient and the second heat transfer coefficient be similar to the relationship in the embodiment described above.

Note that the heat insulation sheets SH may be adhered to the reflecting plate 140, may be adhered to the nip plate 130, or may be merely held between the reflecting plate 140 and the nip plate 130. Furthermore, the relationship between the first heat transfer coefficient and the second heat transfer coefficient may be made similar to the relationship in the embodiment described above by, instead of providing the heat insulation sheets SH, making the surface roughness of the underside of the second portions 140F (or the upper surface of the nip plate 130 with which the underside is in contact) coarser than the surface roughness of the underside of the first portion 140A (or the upper surface of the nip plate 130 with which the underside is in contact).

In the embodiment described above, the cutouts 141C are formed both in the upstream supporting surface 142F and the downstream supporting surface 142R; however, the present disclosure is not limited to the above configuration and, for example, cutouts may be formed only in the upstream supporting surface or cutouts may be formed only in the downstream supporting surface. In other words, even if cutouts are formed only on either of the upstream supporting surface and the downstream supporting surface, an effect similar to that of the embodiment described above can be obtained by having the relationship between the first heat transfer coefficient and the second heat transfer coefficient be similar to the relationship in the embodiment described above.

In the embodiment described above, the cutouts 141C are formed from the ends of the flange portions 142 to the sidewall portions 141B, in other words, among the surfaces constituting the cutouts 141C, one or some of the surfaces (the first surfaces C1, for example) is disposed so as to be spaced apart from the nip plate 130; however, the present disclosure is not limited to the above configuration. For example, small cutouts that can be formed within the area of the flange portion may be formed. In other words, an end of each of the surfaces that constitute the cutouts may be in contact with the nip plate. However, as in the embodiment described above, compared to a structure in which the end of each of the surfaces of the cutouts are in contact with the nip plate, the structure in which, among the surfaces constituting the cutouts 141C, one or some of the surfaces (the first surfaces C1, for example) is disposed so as to be spaced apart from the nip plate 130 can favorably hinder heat from escaping from the nip plate 130 to the second portions 140B.

In the present embodiment described above, the reflecting plate 140 is exemplified as the contact member; however, the present disclosure is not limited to the above reflecting plate 140 and the contact member may be any member that is directly in contact with the nip member. For example, the present disclosure can be applied to structures illustrated in FIGS. 9 to 12.

Specifically, a fixing device 300 according to the present form includes the fixing belt 110, the halogen lamp 120 disposed inside the fixing belt 110, a reflection member 330, a support member 340, a heat insulation member 350, a nip plate 360, and the pressure roller 150. The nip plate 360, the heat insulation member 350, and the support member 340 are each formed in a substantially U-shape in cross-sectional view that open upwards (to the opposite side with respect to the pressure roller 150). The heat insulation member 350 is inserted inside the nip plate 360, and the support member 340 is inserted inside the heat insulation member 350.

The reflection member 330 is disposed above the nip plate 360, the heat insulation member 350, and the support member 340 and the halogen lamp 120 is disposed above the reflection member 330. With the above, radiant heat from the halogen lamp 120 is reflected towards the fixing belt 110 above the halogen lamp 120 with the reflection member 330.

The heat insulation member 350 is an example of a contact member and is configured so as to be in contact directly with the nip plate 360 and to receive the force from the pressure roller 150. The heat insulation member 350 is formed of resin such as a liquid crystal polymer and hinders heat from the halogen lamp 120 from being directly transmitted to the nip plate 360.

Figure 9:
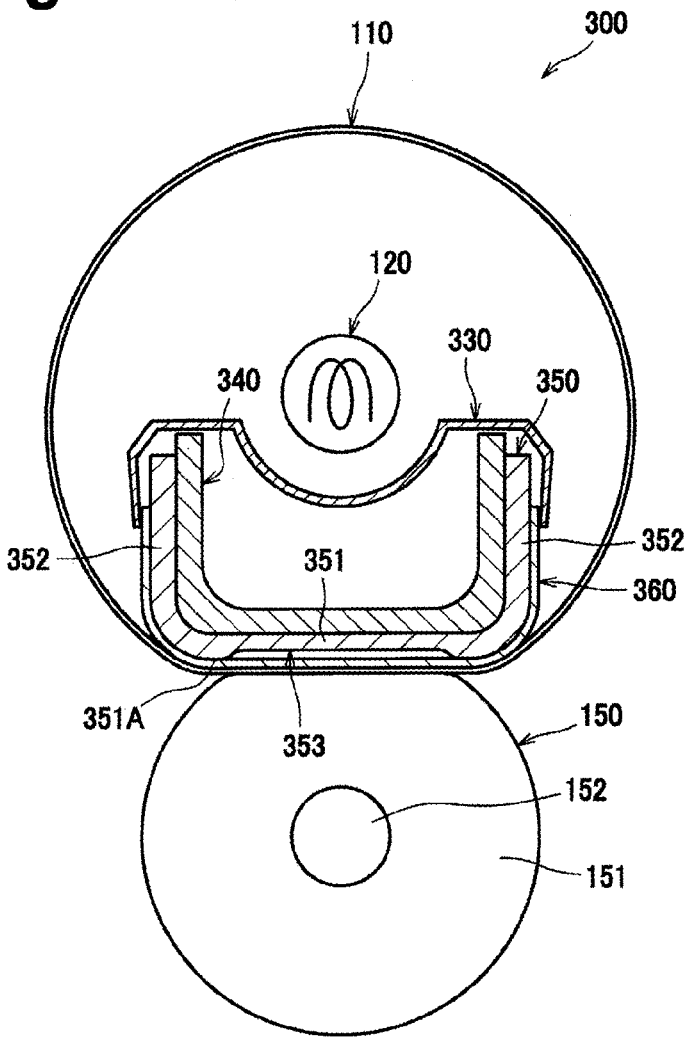
FIG. 9 is a diagram illustrating a third modification.
Figure 10:
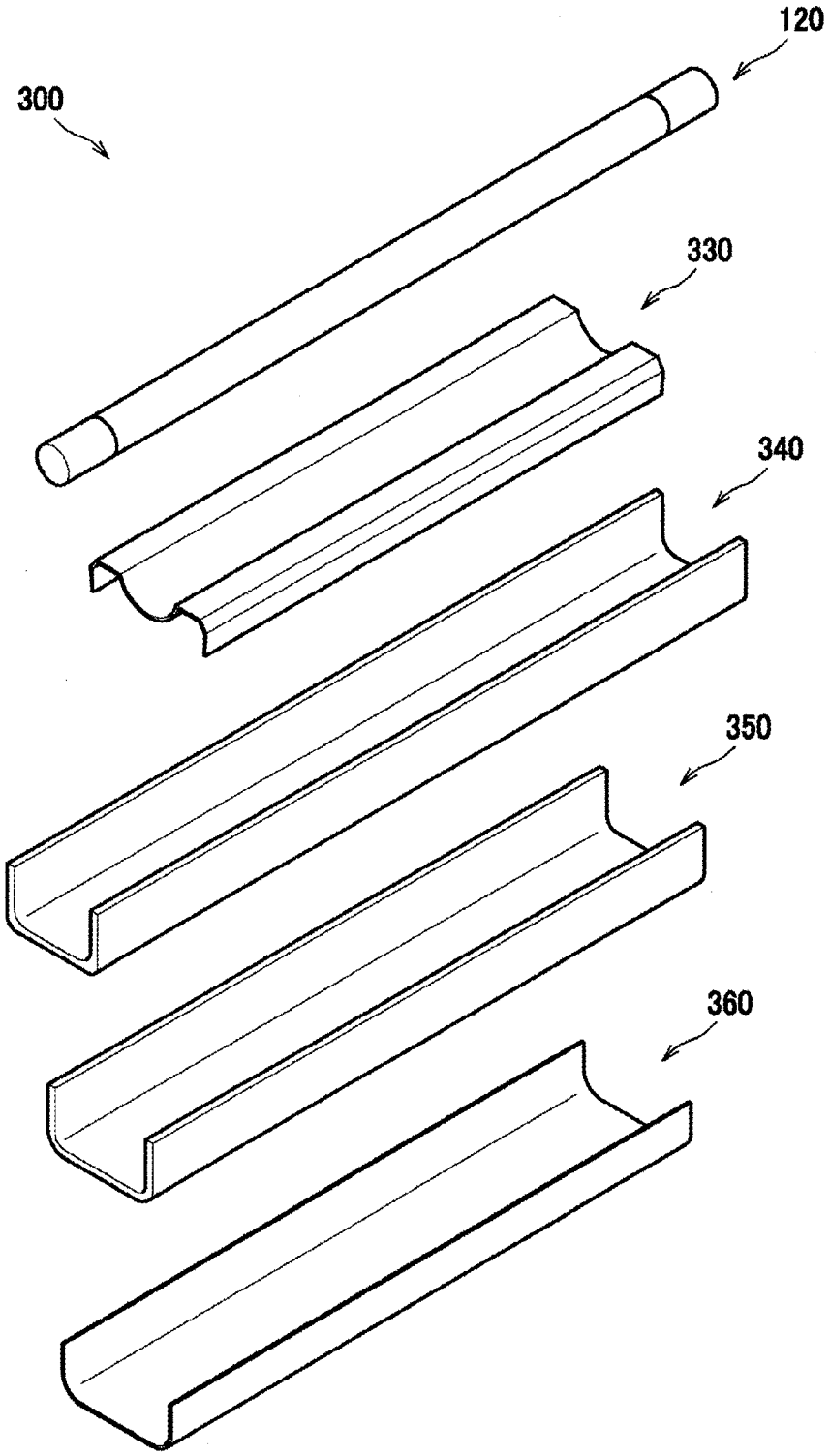
FIG. 10 is an exploded perspective view in which a heat insulation member and other components have been disassembled.
Figure 11:
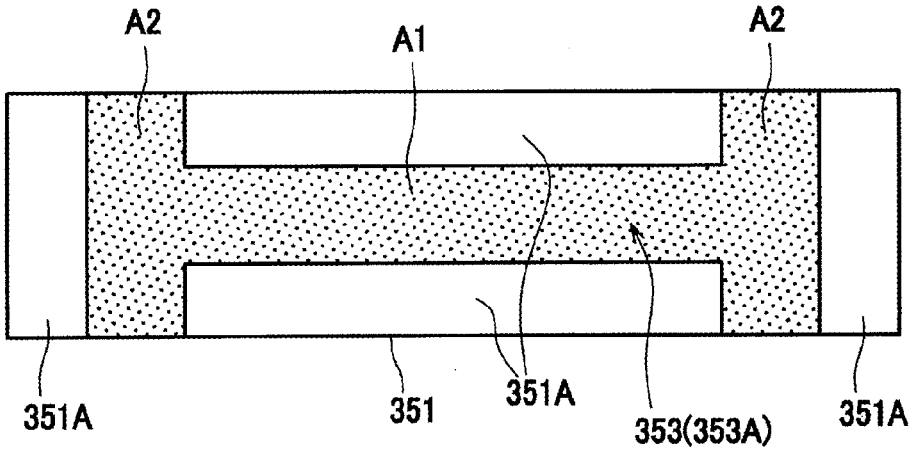
FIG. 11 is a plan view in which the heat insulation member is viewed from below.

The heat insulation member 350 includes a lower wall portion 351 and a pair of sidewall portions 352 that extend upwards from the two edge portions of the lower wall portion 351 in the transport direction. Furthermore, as illustrated in FIGS. 9 and 11, recess 353 that is an example of a cutout and that is recessed upwards from an underside 351A of the lower wall portion 351 is formed in the underside 351A. Note that in FIG. 11, for convenience, the recess 353 is illustrated by dotted hatching.

The bottom surface of the recess 353 is a retreat portion 353A that is disposed so as to be spaced apart from the nip plate 360. The underside 351A is the contact surface. The retreat portion 353A includes an intermittent portion A1 that is provided in the substantially middle portion of the lower wall portion 351 in the transport direction and that extends in the axial direction and a pair of end portions A2 that are provided adjacent to both ends of the intermittent portion A1 in the axial direction and that extend from one edge to the other edge of the lower wall portion 351 in the transport direction. Furthermore, the underside 351A that is in contact with the nip plate 360 is formed on both sides of the intermittent portion A1 in the transport direction and outside of each of the end portions A2 in the axial direction.

Figure 12:
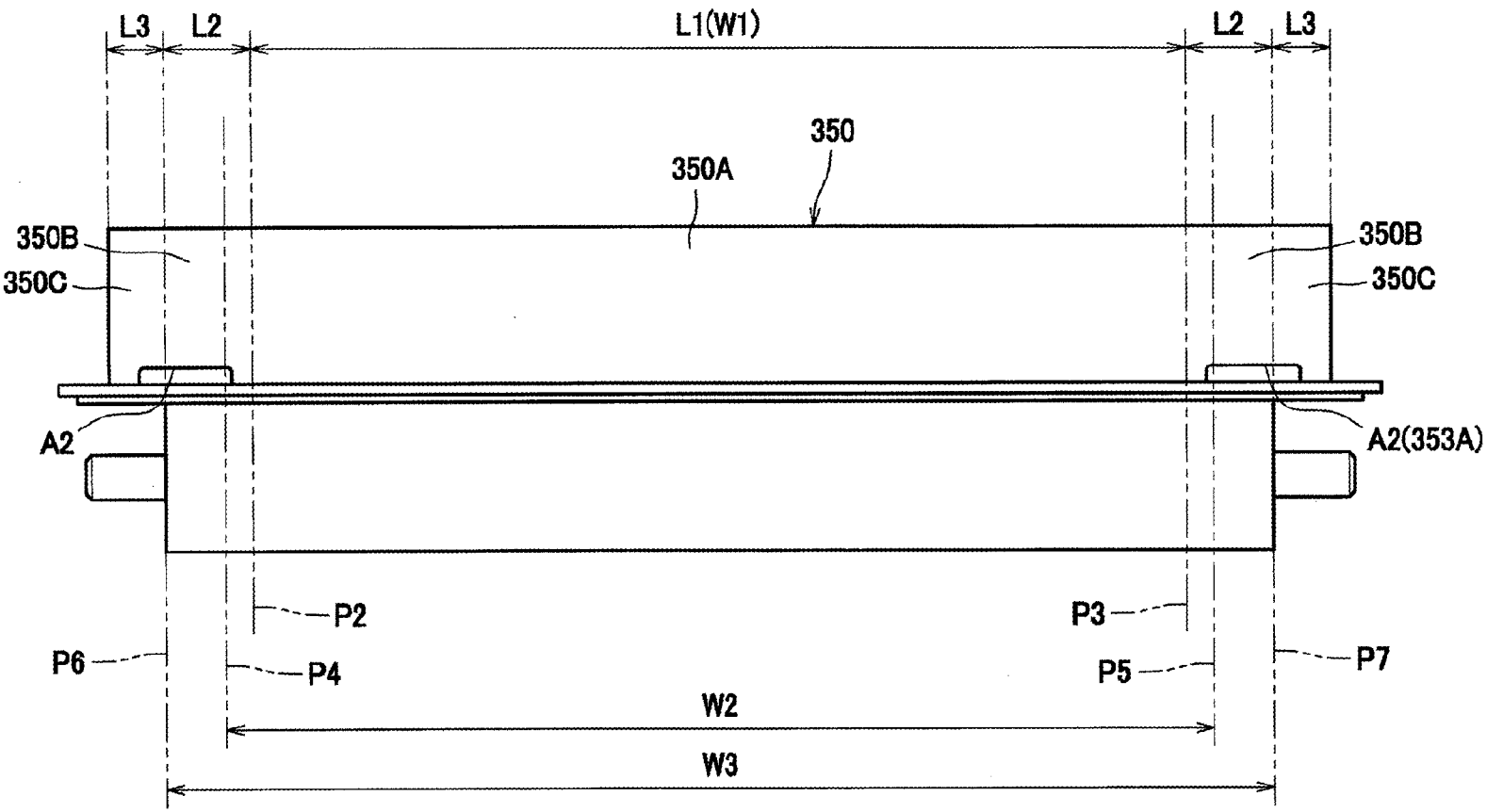
FIG. 12 is a diagram for describing a relationship between a first portion, a second portion, and a third portion.

As illustrated in FIG. 12, the heat insulation member 350 includes a first portion 350A that extends across the width of the maximum image forming area W1 in the axial direction, a pair of second portions 350B positioned outside the width of the maximum image forming area W1 in the axial direction and inside the width W3 of the nip in the axial direction, and a pair of third portions 350C positioned outside the width W3 of the nip in the axial direction. Furthermore, each of the end portions A2 of the retreat portion 353A is formed so as to extend from a position that is outside the corresponding edge (the second plane P2 or the third plane P3) of the maximum image forming area W1 in the axial direction and that is inside the corresponding edge (the fourth plane P4 or the fifth plane P5) of the sheet 51 in the axial direction, the sheet 51 having the maximum sheet passing width W2, to the substantially middle portion of the corresponding third portion 350C.

In such a form as well, an effect similar to that of the embodiment described above can be obtained by having the relationship between the first heat transfer coefficient and the second heat transfer coefficient be similar to the relationship in the embodiment described above. Note that in the present form as well, the relationship between the heat transfer coefficients may be made similar to the relationship in the embodiment described above by, instead of providing the recess 353, providing the heat insulation sheets, such as the ones described above, in the second portion or changing the surface roughness of the first portion and the second portion with respect each other.

Figure 13:
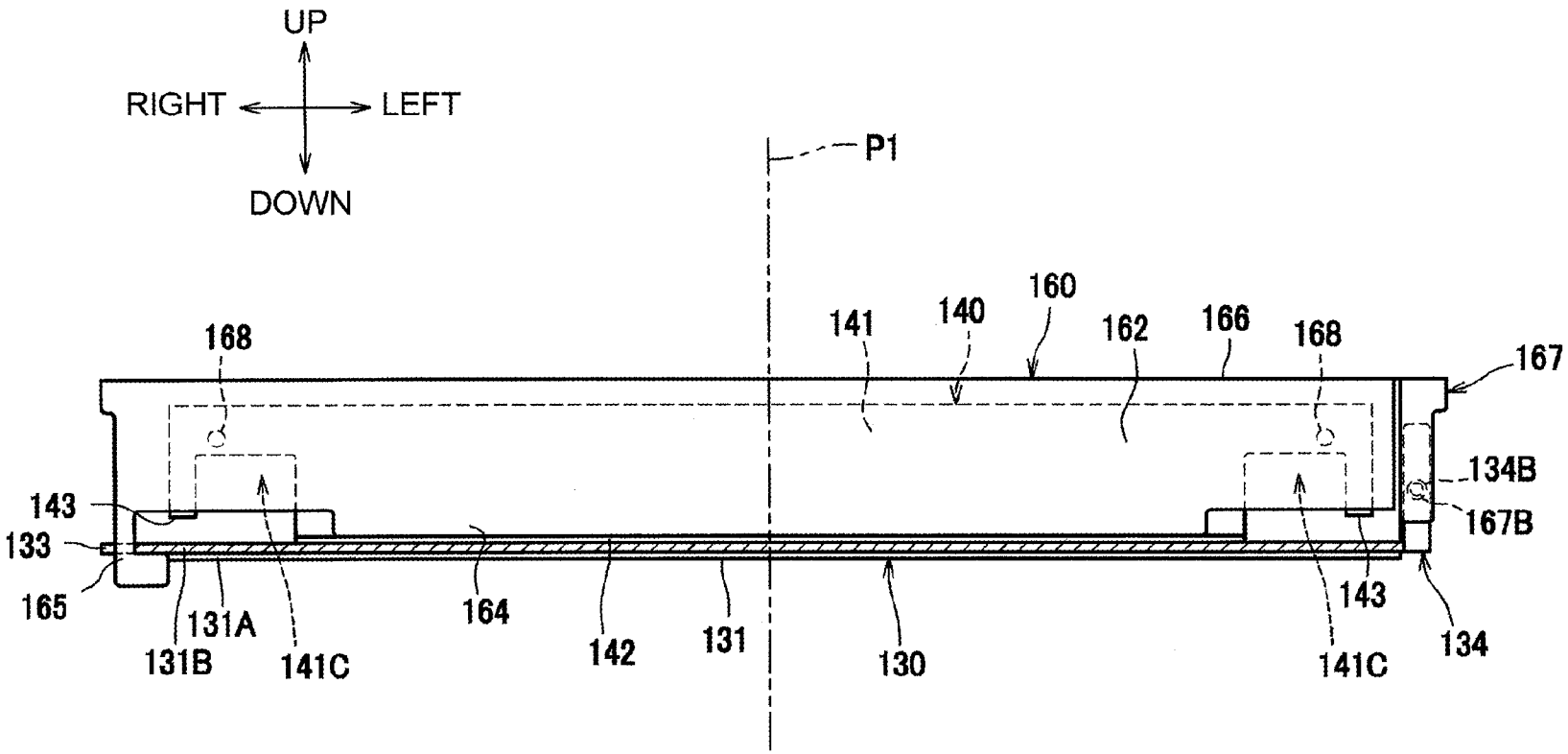
FIG. 13 is a diagram illustrating a fourth modification.

In the embodiment described above, the plurality of support portions 163 are provided in the lower edges of the front wall 161 and the rear wall 162 of the stay 160; however, the present disclosure is not limited to the above configuration and, for example, as illustrated in FIG. 13, a single support 164 that protrudes downwards at the substantially middle portion of the front wall 161 and at the substantially middle portion of the rear wall 162 of the stay 160 in the axial direction and that extends in the axial direction may be provided.

In the embodiment described above, sheet 51 such as a cardboard, a postcard, or thin paper is exemplified as an example of a sheet; however, the present disclosure is not limited to the above sheet 51 and, for example, may be an OHP sheet.

In each of the above-described embodiments, the nip plate is exemplified as an example of the nip member; however, the present disclosure is not limited to the above nip plate and the nip member may be a thick member that does not have a tabular shape, for example.

In the embodiment described above, the pressure roller 150 is exemplified as the backup member; however, the present disclosure is not limited to the pressure roller 150 and, for example, the backup member may be a belt-shaped pressure member.

In the embodiment described above, the present disclosure is applied to the color laser printer 1; however, the present invention is not limited to the above application and may be applied to other image forming apparatuses such as, for example, a copying machine and a multifunction machine.

In each of the above-described embodiments, the halogen lamp 120 is exemplified as an example of the heating element; however, the present disclosure is not limited to the halogen lamp 120 and the heating element may be a carbon heater, for example.

Note that the fixing belt may be a resin film containing polyimide as the main component. In such a case, the surface of the fixing belt is coated with fluororesin, such as PTFE.

In the embodiment described above, support portions of the stay 160 that support the reflecting plate 140 are intermittently formed so as to be protruded and recessed along the axial direction of the fixing belt; however, the support portions may each be formed in a linear manner (in a planar manner) in cross-sectional view that extends from one end to the other end of the stay in the axial direction of the fixing belt.

What is claimed is:

1. A fixing device, comprising:

an endless belt;

a nip member in contact with an inner peripheral surface of the endless belt;

a backup member that nips the endless belt together with the nip member so as to form a nip together with the endless belt; and a contact member disposed opposite the backup member with the nip member therebetween, the contact member being in contact with the nip member, wherein the contact member includes:

a first portion that extends across a width of a maximum image forming area in an axial direction of the endless belt; and a second portion positioned outside the width of the maximum image forming area in the axial direction of the endless belt and inside a width of the nip in the axial direction of the endless belt, wherein a heat transfer coefficient per unit dimension between the nip member and the second portion in the axial direction is smaller than a heat transfer coefficient per unit dimension between the nip member and the first portion in the axial direction, wherein the second portion includes a contact surface that is in contact with the nip member, and the contact surface of the second portion includes a cutout, and wherein the contact member further includes a third portion that is positioned outside the width of the nip in the axial direction, and the cutout extends from an edge of a maximum sheet passing width to the third portion in the axial direction.

2. The fixing device according to claim 1, wherein a contact area per unit dimension between the second portion and the nip member in the axial direction is smaller than a contact area per unit dimension between the first portion and the nip member in the axial direction.

3. The fixing device according to claim 1, wherein the contact member includes:

an upstream supporting surface that supports the nip member; and a downstream supporting surface that is set apart from the upstream supporting surface and that is disposed, with respect to the upstream supporting surface, downstream of the nip in a moving direction of the endless belt, the downstream supporting surface supporting the nip member, and wherein the cutout is formed in the upstream supporting surface.

4. The fixing device according to claim 1, wherein the contact member includes:

an upstream supporting surface that supports the nip member; and a downstream supporting surface that is set apart from the upstream supporting surface and that is disposed, with respect to the upstream supporting surface, downstream of the nip in a moving direction of the endless belt, the downstream supporting surface supporting the nip member, and wherein the cutout is formed in the downstream supporting surface.

5. The fixing device according to claim 1, wherein the contact member includes:

an upstream supporting surface that supports the nip member; and a downstream supporting surface that is set apart from the upstream supporting surface and that is disposed, with respect to the upstream supporting surface, downstream of the nip in a moving direction of the endless belt, the downstream supporting surface supporting the nip member, and wherein the cutout is formed in the upstream supporting surface and in the downstream supporting surface.

6. The fixing device according to claim 1, wherein among surfaces constituting the cutout, one or some of the surfaces is disposed so as to be spaced apart from the nip member.

7. The fixing device according to claim 1, wherein the contact member is a reflection member that reflects radiant heat from a heating element towards the nip member.

8. A fixing device comprising:

an endless belt;

a nip member in contact with an inner peripheral surface of the endless belt;

a backup member that nips the endless belt together with the nip member so as to form a nip together with the endless belt; and a contact member disposed opposite the backup member with the nip member therebetween, the contact member being in contact with the nip member, wherein the contact member includes:

a first portion that extends across a width of a maximum image forming area in an axial direction of the endless belt; and a second portion positioned outside the width of the maximum image forming area in the axial direction of the endless belt and inside a width of the nip in the axial direction of the endless belt, wherein a heat transfer coefficient per unit dimension between the nip member and the second portion in the axial direction is smaller than a heat transfer coefficient per unit dimension between the nip member and the first portion in the axial direction, and wherein the second portion extends perpendicular to the nip member and does not come in contact with the nip member.

9. The fixing device according to claim 8, wherein the second portion includes a cutout and the contact member further includes a third portion that is positioned outside the width of the nip in the axial direction, and the cutout of the second portion extends to the third portion.

10. The fixing device according to claim 8, wherein the second portion includes a cutout and the contact member further includes a third portion that is positioned outside the width of the nip in the axial direction, and the cutout extends from an edge of a maximum sheet passing width to the third portion in the axial direction.

11. The fixing device according to claim 8, wherein a contact area per unit dimension between the second portion and the nip member in the axial direction is smaller than a contact area per unit dimension between the first portion and the nip member in the axial direction.

12. The fixing device according to claim 8, wherein the contact member is a reflection member that reflects radiant heat from a heating element towards the nip member.

13. A fixing device comprising:

an endless belt;

a nip member in contact with an inner peripheral surface of the endless belt;

a backup member that nips the endless belt together with the nip member so as to form a nip together with the endless belt; and a contact member disposed opposite the backup member with the nip member therebetween, the contact member being in contact with the nip member, wherein the contact member includes:

a first portion that extends across a width of a maximum image forming area in an axial direction of the endless belt; and a second portion positioned outside the width of the maximum image forming area in the axial direction of the endless belt and inside a width of the nip in the axial direction of the endless belt, wherein a heat transfer coefficient per unit dimension between the nip member and the second portion in the axial direction is smaller than a heat transfer coefficient per unit dimension between the nip member and the first portion in the axial direction, and wherein a contact surface of the second portion includes a cutout, the contact member further includes a third portion that is positioned outside the width of the nip in the axial direction, and the cutout extends from an edge of the maximum image forming area to the third portion in the axial direction.

14. The fixing device according to claim 13, wherein the contact member includes:

an upstream supporting surface that supports the nip member; and a downstream supporting surface that is set apart from the upstream supporting surface and that is disposed, with respect to the upstream supporting surface, downstream of the nip in a moving direction of the endless belt, the downstream supporting surface supporting the nip member, and wherein the cutout is formed in the upstream supporting surface.

15. The fixing device according to claim 13, wherein the contact member includes:

an upstream supporting surface that supports the nip member; and a downstream supporting surface that is set apart from the upstream supporting surface and that is disposed, with respect to the upstream supporting surface, downstream of the nip in a moving direction of the endless belt, the downstream supporting surface supporting the nip member, and wherein the cutout is formed in the downstream supporting surface.

16. The fixing device according to claim 13, wherein the contact member includes:

an upstream supporting surface that supports the nip member; and a downstream supporting surface that is set apart from the upstream supporting surface and that is disposed, with respect to the upstream supporting surface, downstream of the nip in a moving direction of the endless belt, the downstream supporting surface supporting the nip member, and wherein the cutout is formed in the upstream supporting surface and in the downstream supporting surface.

17. The fixing device according to claim 13, wherein among surfaces constituting the cutout, one or some of the surfaces is disposed so as to be spaced apart from the nip member.

18. The fixing device according to claim 13, wherein the contact member is a reflection member that reflects radiant heat from a heating element towards the nip member.

19. The fixing device according to claim 13, wherein the entire second portion and the nip member do not come in contact with each other.

20. The fixing device according to claim 13, wherein a contact area per unit dimension between the second portion and the nip member in the axial direction is smaller than a contact area per unit dimension between the first portion and the nip member in the axial direction.

* * * * *